US005901793A

United States Patent [19]

Frisbee

[11] Patent Number: 5,901,793

[45] Date of Patent: May 11, 1999

[54] APPARATUS AND METHOD FOR AUTOMATICALLY ADJUSTING THE PITCH OF A DOZER BLADE

[75] Inventor: Claude M. Frisbee, Burlington, Iowa

[73] Assignee: Case Corporation, Racine, Wis.

[21] Appl. No.: 08/984,928

[22] Filed: Dec. 4, 1997

[51] Int. Cl.[6] ..... E02F 3/815

[52] U.S. Cl. ..... 172/816

[58] Field of Search ..... 280/124.102; 267/177, 267/242, 255; 188/321.11, 322.19; 16/72; 37/232, 272, 266; 172/815, 816, 817, 500, 802–807, 826

[56] References Cited

U.S. PATENT DOCUMENTS

| | | | |
|---|---|---|---|
| Re. 21,447 | 5/1940 | Allin | 37/144 |
| 3,086,303 | 4/1963 | Weeks . | |
| 3,700,044 | 10/1972 | Berg . | |
| 3,705,631 | 12/1972 | Seaberg . | |
| 3,706,144 | 12/1972 | Miceli | 37/272 X |
| 3,749,181 | 7/1973 | Jindai . | |
| 3,808,714 | 5/1974 | Reissinger et al. . | |
| 3,823,783 | 7/1974 | Luedtke . | |
| 3,901,563 | 8/1975 | Day . | |
| 4,545,624 | 10/1985 | Van Ooyen . | |
| 4,570,367 | 2/1986 | Oya . | |
| 4,597,202 | 7/1986 | Weeks | 37/232 |
| 4,611,667 | 9/1986 | Tharp | 172/816 X |
| 4,635,387 | 1/1987 | Häring | 37/232 |
| 4,794,710 | 1/1989 | Haring . | |
| 5,010,961 | 4/1991 | Frisbee . | |
| 5,018,284 | 5/1991 | Mikami et al. . | |
| 5,044,614 | 9/1991 | Rau | 267/177 X |
| 5,265,356 | 11/1993 | Winter . | |
| 5,333,697 | 8/1994 | Frisbee et al. . | |
| 5,447,204 | 9/1995 | Asal et al. . | |
| 5,507,352 | 4/1996 | Frisbee et al. . | |
| 5,603,172 | 2/1997 | Maher . | |

*Primary Examiner*—Thomas B. Will
*Assistant Examiner*—Robert Pezzuto
*Attorney, Agent, or Firm*—Jansson, Shupe, Bridge & Munger, Ltd.

[57] ABSTRACT

An apparatus for permitting the pitch of a dozer blade to change automatically during blade use includes a blade member including a housing having a housing wall and a blade attachment portion. An anchor member including a rod is telescoped to the housing and has a rod attachment portion and a retainer attached to the rod. A compression spring is in the housing and exerts force on the wall and the retainer. The rod and blade attachment portions are thereby urged closer to one another and the blade is automatically tipped rearwardly to a "semi-carry" position. During digging with the blade lower edge, the spring allows the blade to tip forwardly. A method for automatically adjusting the blade pitch is also included.

22 Claims, 6 Drawing Sheets

APPARATUS AND METHOD FOR AUTOMATICALLY ADJUSTING THE PITCH OF A DOZER BLADE

FIELD OF THE INVENTION

This invention relates generally to earthworking equipment referred to as dozers (or "bulldozers") and, more particularly, to apparatus for adjusting the pitch of the blades of such equipment.

BACKGROUND OF THE INVENTION

The broad class of equipment known as mobile machinery includes machines known as dozers (sometimes called "bulldozers") which have a front-mounted blade for moving and removing earth as well as other materials atop or near the earth surfaces. Such dozers are sometimes mounted on rubber tires; however, urging the dozer blade through the earth requires very high forward force and for that reason, crawler-mounted dozers are in wide use.

Such dozers are propelled by tracks (much like a military tank) and are capable of exerting high forward force on the blade. Such force is possible since the tracks bite into and engage the ground. Track-ground engagement is quite satisfactory for dozer operations and it is sometimes said the track and the ground are "geared" to one another much like engaged gear teeth.

Dozers remove earth in much the same way that a wood plane shaves wood, i.e., by passing a blade across the earth surface and "rolling up" a layer of earth. Such dozers are employed for road construction and to "shape" the exposed surface of the earth to some contour. They are also used to urge earth to one side or the other of the dozer's travel path rather than merely to push earth straight ahead.

The dozer operator is able to raise or lower the blade and to "skew" it left or right. It is this latter capability which permits earth to be urged to one side of the other. And the operator can also tilt the blade so that one end is higher than the other.

The operator is also able to orient the blade at a different "pitch" which means the blade can be rotated slightly about a horizontal axis extending across the blade. To put it another way, the orientation of the blade can be changed so that the blade angles slightly upwardly.

Until the advent of the invention, adjustment of blade pitch was done relatively infrequently, largely because it was difficult and time-consuming. But the ability to do so is important at least for the following reasons. In hard earth or other material, the lower blade cutting edge can be positioned closer to vertical to better penetrate such material. On the other hand, when the blade is "laid back," the capacity of such blade to carry soft or loose material is increased.

Manufacturers of dozers provide for blade pitch adjustment in a variety of ways. One way involves removing bolts at an attachment point near the lower rear of the blade and adding or removing shims to change blade pitch. Another way is by extending and retracting hydraulic cylinders to change such pitch. Yet another way involves a swinging link pivotably pinned at one end and having two apertures, either of which can accept a blade pin. Blade pitch is a function of which aperture is selected. It is understood that not all related parts are used in both blade pitch positions and this would present the risk of losing unused parts.

Arrangements involving hydraulic cylinders for pitch adjustment are shown in U.S. Pat. Nos. 4,074,769 (Frisbee) and 3,700,044 (Berg). Yet another arrangement for changing blade pitch is shown in U.S. Pat. No. 4,893,683 (Horsch et al.).

The device in the Frisbee patent includes a plate with several sets of bolt holes. Pitch is changed by removing the bolts, moving the plate until another set of its holes is aligned with the bolt holes and re-installing the bolts. The Berg patent involves an arrangement that includes a control lever that controls two bellcranks which in turn control two valves that transmit fluid to actuators which provide a pivoting and tilting action for the bulldozer blade. The direction of fluid flow is dependant on the position of the bell-cranks which must be maneuvered from the operator's seat. Each bellcrank is returned to a neutral position by a spring mechanism in the valves which also returns the lever to a neutral position. The arrangement of the Horsch et al. patent involves reversing the positions of two bearing plates which are of differing thicknesses.

Still other arrangements are shown in U.S. Pat. Nos. 5,333,697 (Frisbee et al.) and 5,507,352 (Frisbee et al.). Both the '697 and '352 patent includes a flip block mounted on trunnions positioned toward one edge of the block. The block is rotated about 180° on the trunnions to either one of two available positions, each of which "sets" the blade at a different pitch until it is again changed manually.

While these arrangements have been generally satisfactory, some of them are attended by certain disadvantages. For example, in the arrangement involving the installation or removal of shims, the work must be performed near ground level and upon a mechanism which, more likely than not, is caked with dirt. And, of course, the arrangement assumes that the required shims will be readily available when needed—such assumption is not always correct.

While the use of hydraulic cylinders is very convenient for the operator, it is more costly to manufacture (and buy) in that the cylinders, hydraulic plumbing and pitch control valve are all required to be installed on the dozer. The swinging link arrangement is vary difficult for one person to adjust at lest in that it requires aligning a pin with a hole which may require dozer movement simultaneous with link-pin engagement. And special tools may be required to effect pitch change. As to the arrangement of the Frisbee et al. patent, it has been found that the cost to manufacture the flip block is unacceptable.

OBJECTS OF THE INVENTION

An object of the invention is to provide a mechanism and a method for automatically adjusting the pitch on a dozer blade which overcome some of the problems and shortcomings of the prior art.

Another object of the invention is to provide a method and mechanism for automatically adjusting the pitch on a dozer blade that enable the operator to adjust the range of allowable pitch.

Still another object of the invention is to provide a mechanism and a method for automatically adjusting the pitch on a dozer blade which enable an operator to override the mechanism and lock the blade in a fixed position.

Yet another object of the invention is to provide a mechanism and a method for automatically adjusting the pitch on a dozer blade that does not require the use of hydraulic fluid. How these and other objects are accomplished will become apparent from the following descriptions and from the drawings.

SUMMARY OF THE INVENTION

The invention involves a mechanism for permitting the pitch of a dozer blade to change during blade use. The invention includes a blade member comprising a housing that includes a housing wall and a blade attachment portion such as an apertured clevis with a self-aligning bushing. An anchor member comprising a rod is telescoped to the housing and has a rod attachment portion, e.g., another clevis, and a retainer attached to the rod.

A compression spring is "captured" between the retainer and the housing wall and exerts force on both. In the absence of digging forces on the lower edge of the blade, the blade attachment portion is urged closer to the rod attachment portion. As this occurs, the blade is tipped more rearwardly to what might be termed a "semi-carry" position to permit carrying earth from one place to another after digging. Digging by engaging the lower edge of the blade to the earth further compresses the spring, causes the blade attachment portion to move away from the rod attachment portion and permits the blade to tip more forwardly.

In one embodiment of the invention, the spring is located between the rod and the housing and the spring, rod and housing are generally coaxial with one another. In such embodiment, the housing wall and the retainer are spaced by a variable dimension. The mechanism includes a stop device for setting the minimum dimension between the housing and the retainer and, therefore, for setting the maximum rearward pitch of the blade. Such stop device includes a pair of position holders affixed to the housing and a yoke coupled to the position holders. The yoke coacts with the rod and limits movement of the housing relative to the retainer.

A preferred embodiment of the invention involves an improvement to a combination involving a dozer blade that has a digging edge and is coupled to a mounting stanchion. The blade pitch mechanism has its anchor member pivotally attached to the stanchion and its blade member pivotally attached to an upper portion of the blade.

More specifically, the anchor member is coupled to the mounting stanchion by a first attachment portion while the blade member is coupled to the upper portion of the blade by a second attachment portion. The attachment portions are spaced from each other by a variable dimension. The improvement concerns the pitch mechanism which includes a resilient member that coacts between the anchor member and the blade member and thereby causes the dimension between the attachment portions to diminish in order to change blade pitch in the absence of substantial force applied to the digging edge of the blade.

In a specific version of the preferred embodiment, the blade member also has a housing. The anchor member includes a rod that extends into the housing where a retainer is attached to it, thereby allowing the resilient member to coact between the housing and the retainer.

In yet another aspect of the invention, the second attachment portion is fixed with respect to the housing that includes an end wall that is spaced from the second attachment portion. In this variation, the resilient member is a spring that is compressed between the end wall and the retainer.

In still another aspect of the invention, the mechanism includes a grease-actuated piston that coacts between the rod and the second attachment portion. Pumping grease into the piston (as with a common grease gun) or bleeding grease out of the piston adjusts the position of the retainer with respect to the housing end wall.

Most preferably, the combination includes a stop device for limiting the dimension between the rod and blade attachment portions. Such stop device includes a pair of position holders that are fixed with respect to the blade member and, particularly, are fixed with respect to the housing around the spring. A U-shaped yoke is releasably coupled to the position holders by pins and coacts with the anchor member to limit movement of the blade member relative to the anchor member.

In a more specific aspect of this version, the yoke includes a face portion with two leg portions extending from it and a rod extending through it. Each of the leg portions have a plurality of apertures. A collar surrounds the rod and abuts the face portion when the dimension is at its maximum. Each of the position holders has a hole, and a separate pin extends into a respective one of the leg portions and a respective one of the holes, thereby securing the yoke and the blade member to one another.

Another aspect of the invention involves a method for automatically adjusting the pitch on a dozer blade. The method includes the steps of: (1) providing a dozer blade assembly that includes (a) a dozer blade having a top portion and a bottom digging edge, (b) a frame, (c) a mounting stanchion fixed with respect to the frame, (d) a lift cylinder coupled to the frame, (e) an angle cylinder extending between the frame and the blade, (f) a tilt cylinder, and (g) a blade pitch mechanism having an anchor member attached to the stanchion, a blade member attached to the top portion and a resilient member coacting between the anchor member and the blade member; (2) engaging the ground with the digging edge, thereby applying a force along such edge; and (3) compressing the resilient member between the blade member and the anchor member, thereby permitting the blade to pitch forwardly.

In another variation of the method, the anchor member includes a rod, the blade member has a housing and the compressing step includes moving the housing along the rod. In such variation, the blade pitch mechanism might also include a stop device for adjustably limiting movement of the blade member with respect to the anchor member. Such stop device would include a pair of position holders fixed with respect to the blade member and a yoke releasably coupled to the position holders and coacting with the anchor member to limit movement of the blade member relative to the anchor member. Using a stop device, the engaging step may be preceded by the step of setting the relative positions of the holders and the yoke to one another.

In still another variation of the method, the compressing step is followed by lifting the dozer blade lower edge from the ground and expanding the resilient member. Such expansion results in the top portion of the blade tilting rearwardly for dirt carrying.

DETAILED DESCRIPTIONS OF THE PREFERRED EMBODIMENTS

Figure 1:
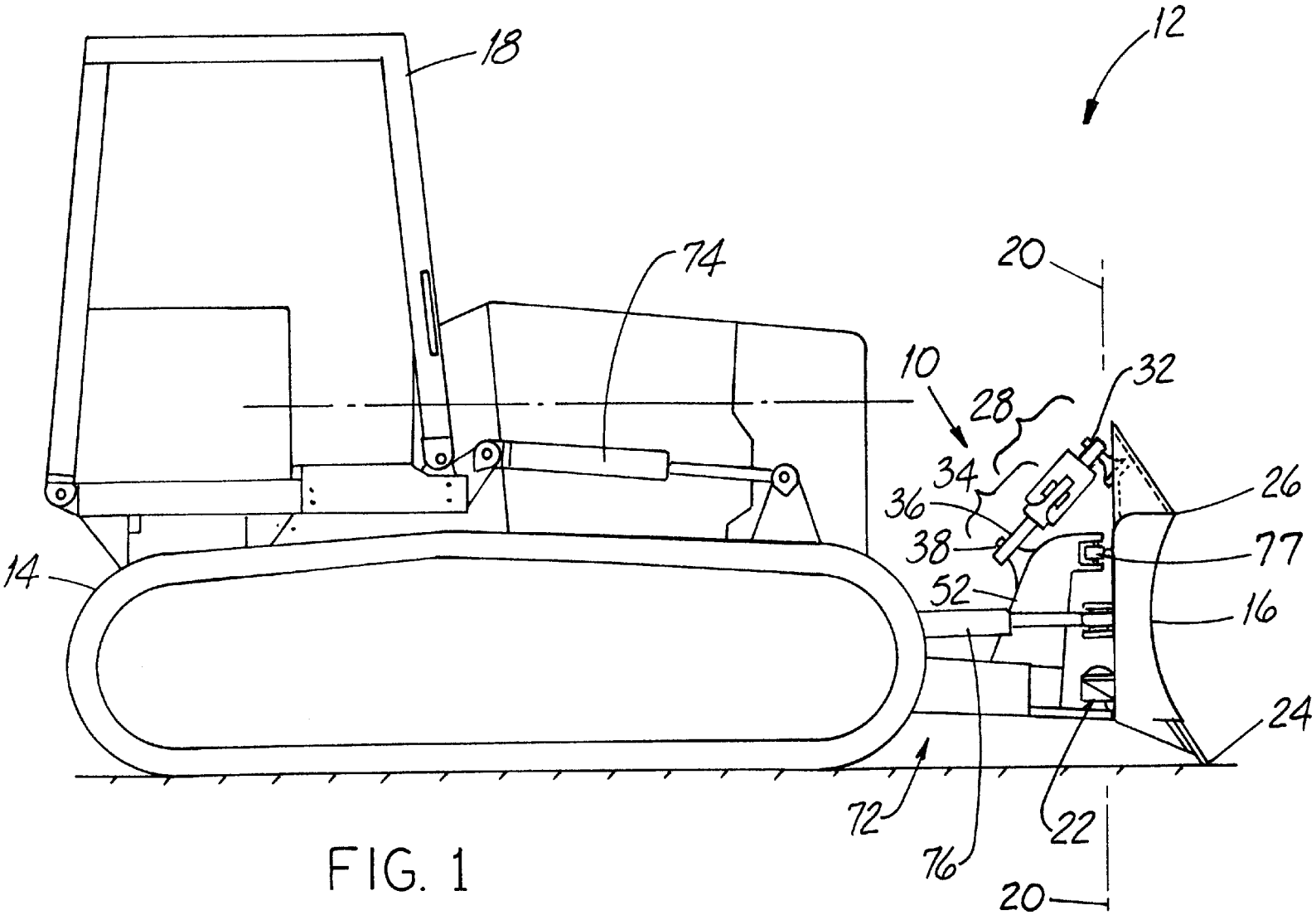
FIG. 1 is a representative side elevation view of a crawler dozer equipped with the new apparatus.

Referring first to FIG. 1, the inventive apparatus 10 is shown in conjunction with a dozer 12 (sometimes referred to as a "bulldozer") which is mounted on crawler tracks 14 for propulsion and which is equipped with a dozer blade 16. From the seat in the cab 18, the operator can control the tilt, angle and raise/lower positions of the blade 16 to perform a particular task. When the blade 16 is angled left or right (or "skewed"), the blade pivots about an axis 20 extending through the bottom pivot mount 22. When the blade cutting edge 24 is horizontal, the axis 20 is vertical.

From the perspective of FIG. 1, one can appreciate why the blade cutting edge 24 better penetrates hard material "chisel-like" if such edge 24 is oriented more vertically. One can also appreciate how the blade 16 can carry more material if its top edge 26 is pitched to the rear so that the blade 16 "faces" upwardly somewhat.

Figure 2:
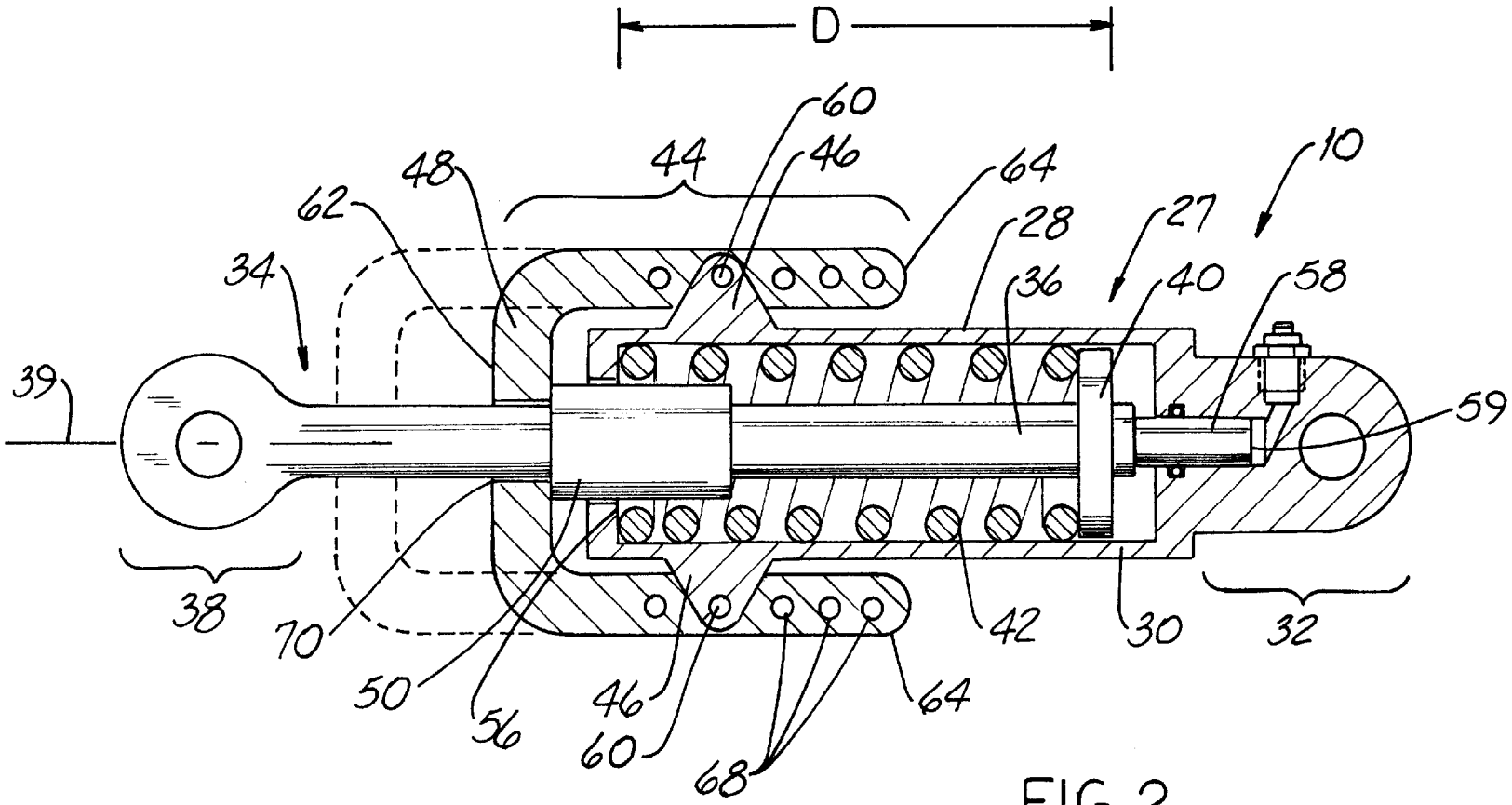
FIG. 2 is a side view of the inventive apparatus. Parts are shown in section, other parts are shown in full representation and surfaces of parts are shown in dashed line.
Figure 8:
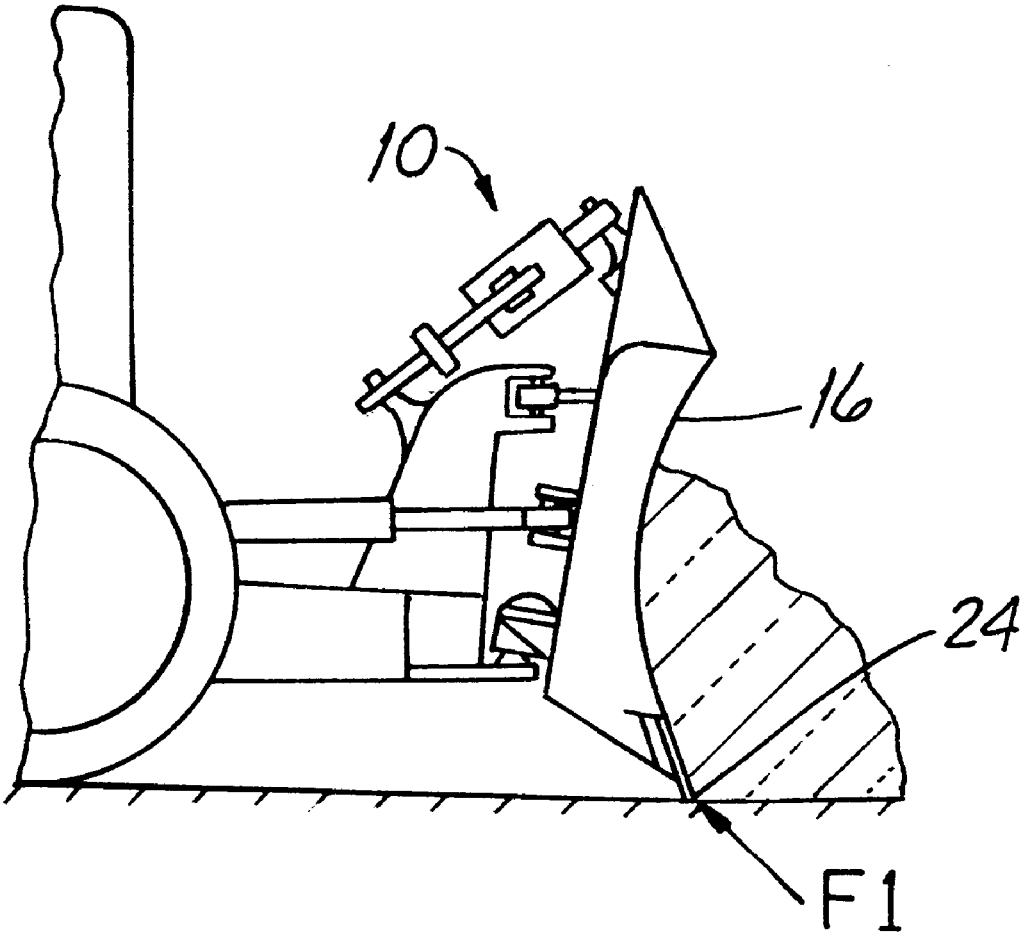
FIG. 8 is a representative side elevation view generally like that of FIG. 1 showing the extended position of the inventive apparatus when the blade is digging. Parts are broken away.

FIGS. 1 and 8 shows the apparatus 10 which permits the pitch of a dozer blade 16 to change automatically during blade 16 use in response to the force F1 (shown in FIG. 8) imparted along the cutting edge 24. Such force F1 occurs when the blade 16 digs into or scrapes along a surface. The apparatus 10, as shown in FIGS. 1 and 8, is secured to the dozer 12 and the blade 16 by a first or rod attachment portion 38 and a second or blade attachment portion 32, respectively. The apparatus 10, shown in FIGS. 2–6 and 9–11, includes a blade member 27 comprising a housing 28 with a housing wall 30 and the blade attachment portion 32 such as an apertured clevis with a self-aligning bushing. An anchor member 34 comprising a rod 36 is telescoped to the housing 28 and includes the rod attachment portion 38, e.g., another clevis, and a retainer 40 attached to the rod. As shown in FIG. 2, the housing 28, the portions 32, 38 and the rod 36 are all coincident with the apparatus long axis 39.

A resilient member such as compression spring 42 is "captured" between the retainer 40 and the housing end wall 56 and exerts force on both. In the absence of digging forces F1 on the lower edge 24 of the blade 16, the blade attachment portion 32 is urged closer to the rod attachment portion 38. Depending upon the particular blade 16, pre-loading the spring 42 may be required. The spring 42, bearing against the retainer 40 and urging the wall 56 leftwardly as viewed in FIG. 2, tips the blade 16 more rearwardly, as shown in FIG. 1 to what might be termed a "semi-carry" position. Such position permits carrying earth from one place to another after digging. As shown in FIG. 8, digging by engaging the lower edge 24 of the blade 16 to the earth applies a force F1 to the lower edge 24 that further compresses the spring 42 by urging the end wall 56 toward the retainer 40. The force F1 thereby causes the blade attachment portion 32 to move away from the rod attachment portion 38, thus permitting the blade 16 to tip more forwardly.

Figure 6:
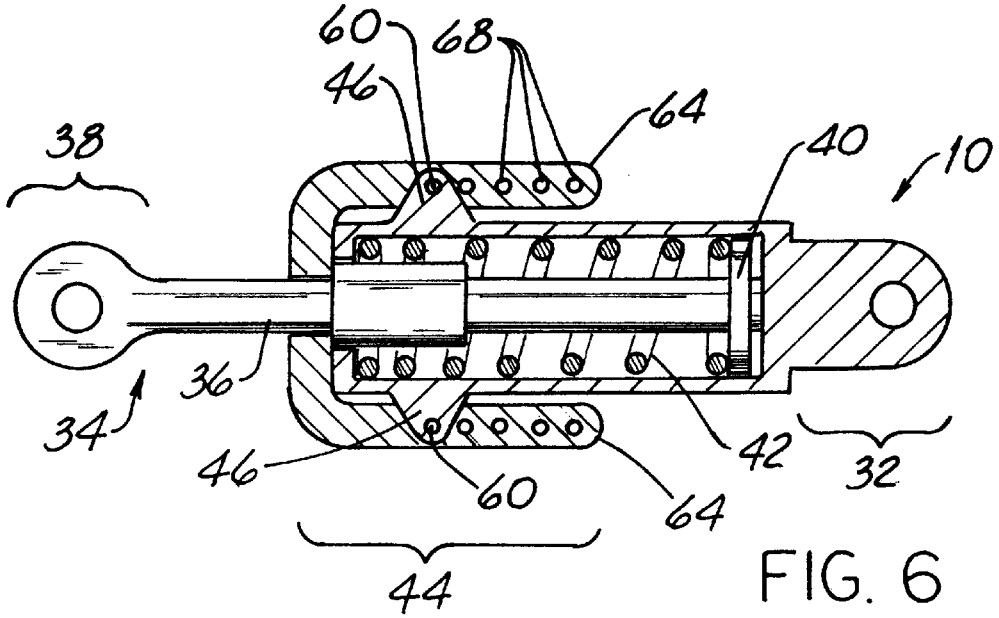
FIG. 6 is another side view of the apparatus with its position holders pinned to the yoke leg portions at locations which prevent substantial extension of the apparatus.

In a specific embodiment of the invention, the spring 42 is located between the rod 36 and the housing 28 and the spring 42, rod 36 and housing 28 are generally coaxial with one another. In such embodiment, the housing wall 30 and the retainer 40 are spaced by a variable dimension D. The apparatus 10 includes a stop device 44, as shown in FIGS. 2 and 6, for setting the minimum dimension between the housing 38 and the retainer 40 and, therefore, for setting the maximum rearward pitch of the blade 16. Such stop device 44 includes a pair of position holders 46 affixed to the housing 28 and a yoke 48 coupled to the position holders 46. The yoke 48 coacts with the rod 36 and the housing 28 by allowing the rod 36 to pass through the yoke 48. Such passage is limited by a collar 50 that surrounds a portion 36 of the rod and is incapable of passing through the yoke 48. Such collar 50 thus limits movement of the housing 28 relative to the retainer 40.

A preferred embodiment of the invention involves an improvement to a combination involving a dozer blade 16 that has a digging edge 24 and is coupled to a mounting stanchion 52. The blade pitch mechanism 10 has its anchor member 34 pivotally attached to the stanchion 52 and its blade member 27 pivotally attached to an upper portion 26 of the blade 16.

More specifically, the anchor member 34 is coupled to the mounting stanchion 52 by the first attachment portion 38 while the blade member 27 is coupled to the upper portion 26 of the blade 16 by the second attachment portion 32 which is fixed with respect to the housing 28. The attachment portions 32, 38 are spaced from each other by a dimension which may be permitted to vary, depending upon how the blade 16 is being used.

FIG. 2 and 9–11, shows still another aspect of the invention in which the apparatus 10 includes a grease-actuated piston 58 that coacts between the rod 36 and the second attachment portion 32. Pumping grease into the piston chamber 59 (as with a common grease gun) or bleeding grease out of the chamber 59 adjusts the position of the retainer 40 with respect to the housing 28 end wall 56.

Most preferably, as shown in FIGS. 2 and 6, the combination includes a stop device 44 for limiting the dimension between the rod 36 and blade attachment portions 32. Such stop device 44 includes a pair of position holders 46 that are fixed with respect to the attachment portion 32 and, particularly, are fixed with respect to the housing 28 around the spring 42. A U-shaped yoke 48 is releasably coupled to the position holders 46 by pins 60 and coacts with the anchor member 34 to limit movement of the blade member 16 relative to the anchor member 34.

Figure 7:
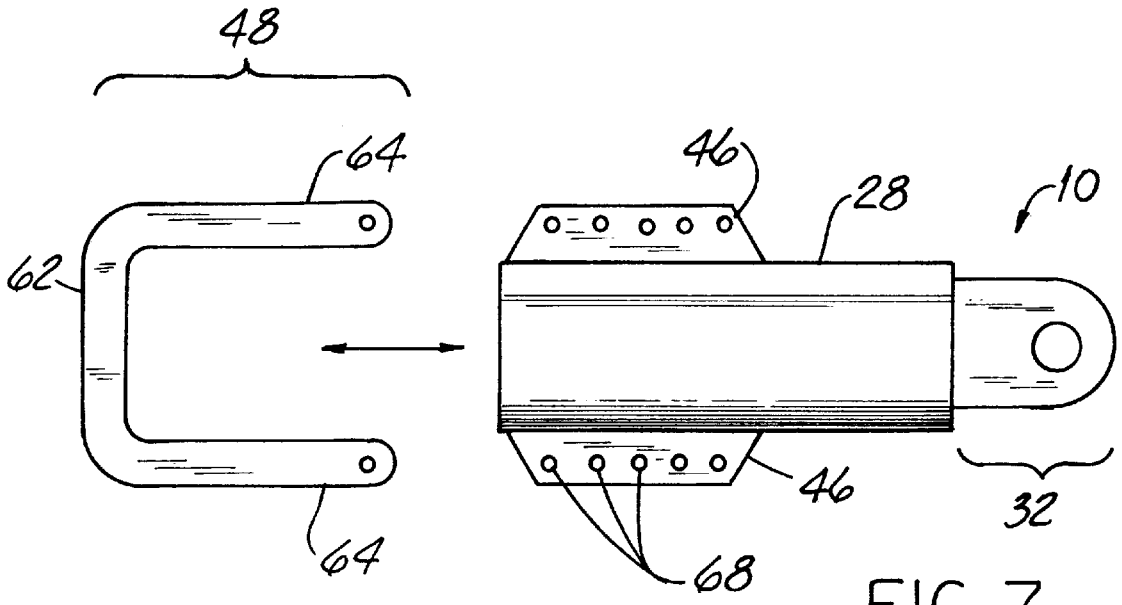
FIG. 7 is a side view showing the yoke and the housing of the apparatus.

FIGS. 2–6 show a more specific aspect of this version where the yoke 48 includes a face portion 62 with two leg portions 64, 66 extending from it and a rod 36 extending through it. Each of the leg portions 64, 66 have a plurality of apertures 68. A collar 50 surrounds the rod 36 and abuts the face portion 62 when the dimension is at its maximum. Each of the position holders 46 has a aperture 68, and a separate pin 60 extends into a respective one of the leg portions 64, 66 and a respective one of the apertures 68, thereby securing the yoke 48 and the blade member 27 to one another. FIG. 7 shows an aspect of the invention where the leg portions 64, 66 each have a single aperture 68 and the position holder 46 each have a plurality of apertures 68.

Figure 3:
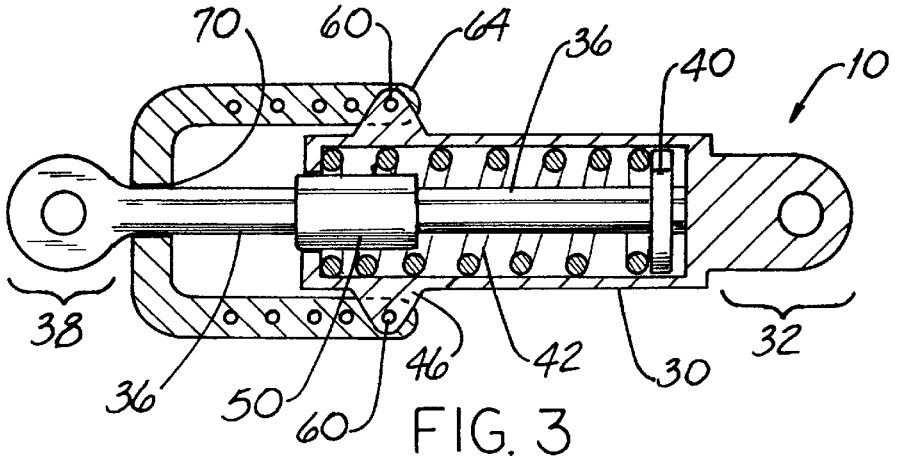
FIG. 3 is a view of the apparatus generally like that of FIG. 2 with the apparatus in its repose position as it would be when the dozer blade is tipped somewhat rearwardly for carrying dirt.
Figure 4:
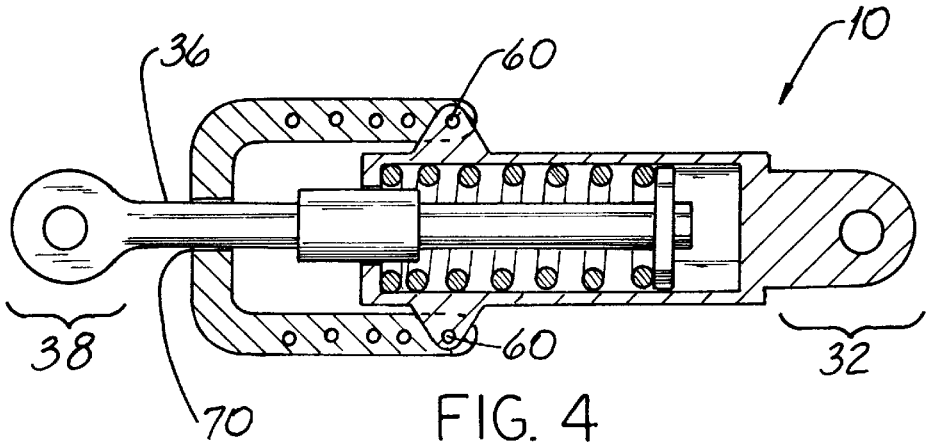
FIG. 4 is a view of the apparatus generally like that of FIG. 2 with the apparatus in a partially-extended position as it would be when the dozer blade is used for digging, moderate force is being applied to the blade cutting edge and the blade is tipped somewhat forwardly.
Figure 5:
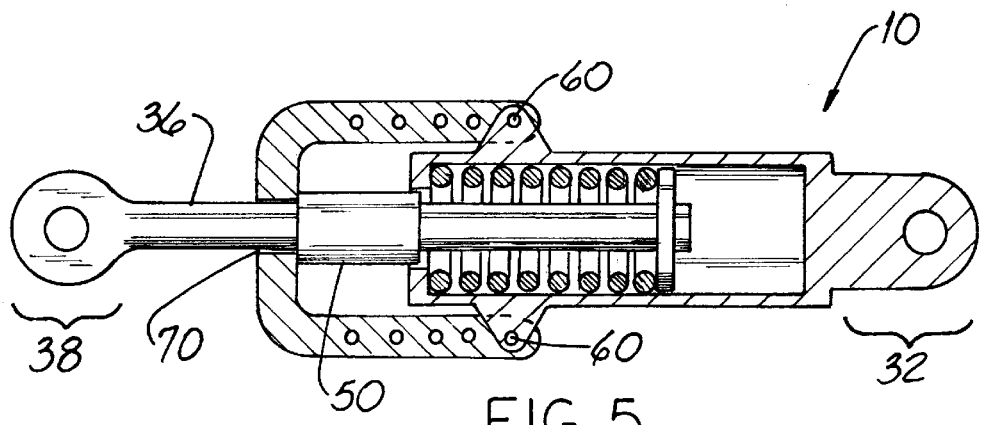
FIG. 5 is a view of the apparatus generally like that of FIG. 2 with the apparatus in a fully-extended position as it would be when the dozer blade is used for digging, high force is being applied to the blade cutting edge and the blade is tipped to its forward limit.

Comparing FIGS. 1 and 8 and referring also to FIGS. 2, 3 and 5, when the blade 16 is substantially upright as in FIG. 1, the attachment portions 32, 38 are more closely proximate one another and the spring 42 is extended, as shown in FIGS. 2 and 3. When the blade 16 is digging and the apparatus 10 has permitted the blade 16 to tip forwardly as in FIG. 8, the attachment portions 32, 38 are spaced a greater distance from one another and the spring 42 is compressed, as shown in FIG. 5.

Figure 9:
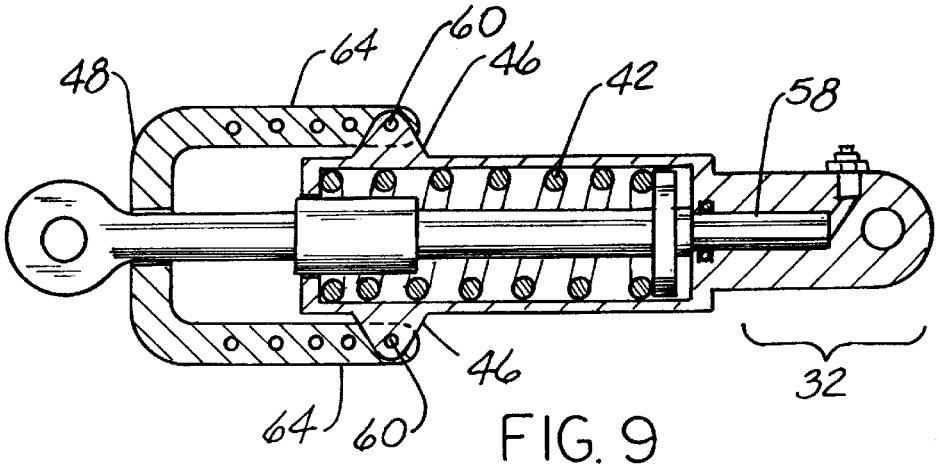
FIG. 9, 10 and 11 are side elevation views of another embodiment of the apparatus shown in the same sequence of dozer operations as FIGS. 3, 4 and 5.
Figure 10:
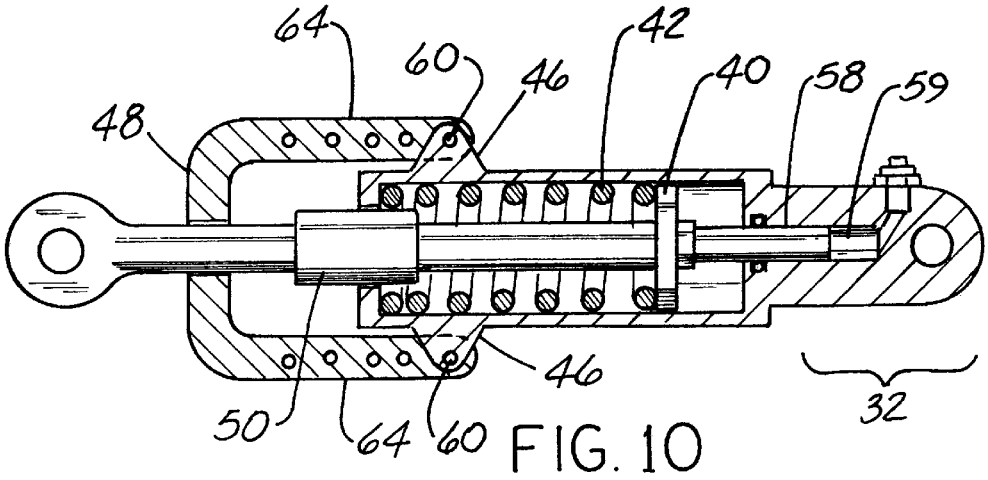
Figure 11:
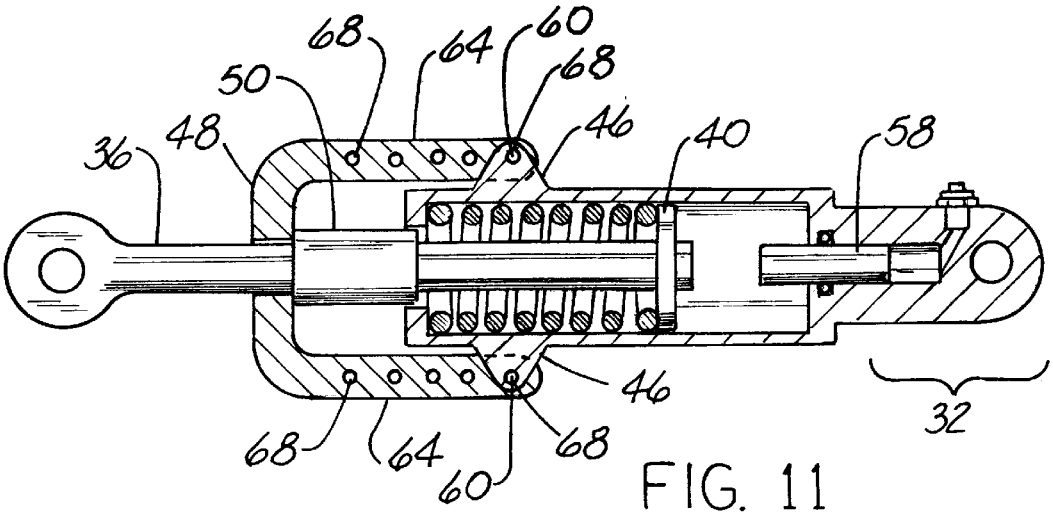

FIGS. 9, 10 and 11, viewed in that order, show how the configuration of the apparatus 10 changes when the blade 16 moves from the upright position of FIG. 1 to the tipped position of FIG. 8. And a comparison of FIGS. 9 and 10 shows how the spring 42 can be further compressed (beyond its initial compression) by pumping grease into the piston chamber 59. The effect on blade position is to tip the blade 16 somewhat forwardly even though no digging is taking place. FIG. 11 shows how the spring 42 is further compressed from the position shown in FIG. 10 when the blade 16 is used for digging and the retainer 40 has moved away from the piston 58.

In FIG. 11, it will be noted that the collar 50 contacts the yoke 48, preventing further compression of the spring 42. In a specific embodiment, such relationship occurs only when the apertures 68 of the position holders 46 are in registry with those apertures 68 of the leg portions 64 which are furthermost from the yoke 48.

On the other hand, if the apertures 68 of the position holders 46 are in registry with apertures 68 of the leg portions 64 which are closer to the yoke 48, the collar 50 contacts the yoke 48 and results in a different spacing between the attachment portions 32, 28. Thus, by "setting" the position holders 46 at any one of several available positions along the leg portions 64, the illustrated arrangement can be configured to adjustably set the maximum spacing between the attachment portions 32, 38.

Another aspect of the invention involves a method for automatically adjusting the pitch on a dozer blade 16. The method includes the steps of: (1) providing a dozer blade assembly that includes (a) a dozer blade 16 having a top portion 26 and a bottom digging edge 24, (b) a frame 72, (c) a mounting stanchion 52 fixed with respect to the frame 72, (d) a lift cylinder 74 coupled to the frame 72, (e) an angle cylinder 76 extending between the frame 72 and the blade 12, (f) a tilt cylinder 77, and (g) a blade pitch apparatus 10 having an anchor member 34 attached to the stanchion 52, a blade member 16 attached to the top portion 32 and a resilient member such as spring 52 coacting between the anchor member 34 and the blade member 16. The method includes: (2) engaging the ground with the digging edge 24, thereby applying a force along such edge 24; and (3) compressing the spring 52 between the blade member 16 and the anchor member 34, thereby permitting the blade 16 to pitch forwardly.

In another variation of the method, the anchor member 34 includes a rod 36, the blade member 16 has a housing 28 and the compressing step includes moving the housing 28 along the rod 36. In such variation, the blade pitch apparatus 10 might also include a stop device 44 for adjustably limiting movement of the blade member 16 with respect to the anchor member 34. Such stop device 44 would include a pair of position holders 46 fixed with respect to the blade member 16 and a yoke 48 releasably coupled to the position holders 46 and coacting with the anchor member 34 to limit movement of the blade member 16 relative to the anchor member 34. Using a stop device 44, the engaging step may be preceded by the step of setting the relative positions of the holders 46 and the yoke 48 to one another.

In still another variation of the method, the compressing step is followed by lifting the dozer blade 16 lower edge 24 from the ground and expanding the spring 52. Such expansion results in the top portion 26 of the blade 16 tilting rearwardly for dirt carrying.

While the principles of the invention have been shown and described in connection with but a few embodiments, it is to be understood clearly that such embodiments are by way of example and are not limiting.

What is claimed:

1. An apparatus for permitting the pitch of a dozer blade to change during blade use and including:

a blade member comprising a housing having a housing wall, the housing being terminated at one end by a blade attachment portion rigidly affixed to the housing;

an anchor member comprising a rod telescoped to the housing and having a rod attachment portion and a retainer attached to the rod; and a compression spring exerting force on the wall and the retainer, thereby urging the rod and blade attachment portions closer to one another;

and wherein:

the apparatus extends along a long axis;

the blade attachment portion and the rod attachment portion are coincident with the long axis; and the apparatus is support-free between the blade attachment portion and the rod attachment portion.

2. The apparatus of claim 1 wherein:

the spring is between the rod and the housing; and the spring, rod and housing are generally coaxial with one another.

3. The apparatus of claim 2 wherein the housing and the retainer are spaced by a variable dimension and the apparatus includes a stop device for setting the minimum dimension between the housing and the retainer, the stop device including:

a pair of position holders affixed to the housing; and a yoke coupled to the position holders and coacting with the rod to limit movement of the housing relative to the retainer.

4. In combination, (a) a one-piece dozer blade coupled to a mounting stanchion and having a digging edge, and (b) a blade pitch apparatus having an anchor member coupled to the stanchion by a first attachment portion and a blade member coupled to an upper portion of the blade by a second attachment portion, and wherein the attachment portions are spaced by a variable dimension, the improvement wherein:

the pitch apparatus has a first end terminated by the first attachment portion;

the pitch apparatus includes an anchor member extending away from the first attachment portion and being terminated by the second attachment portion;

the attachment portions are axially aligned; and the pitch apparatus includes a resilient member coacting between the anchor member and the blade member, thereby allowing the dimension to diminish to change blade pitch when force is applied to the digging edge.

5. The combination of claim 4 wherein:

the blade member includes a housing having an end wall;

the anchor member includes a rod extending into the housing and a retainer attached to the rod;

the resilient member coacts between the housing end wall and the retainer and urges the end wall and the housing away from the first attachment portion.

6. The combination of claim 5 wherein:

the second attachment portion is rigidly fixed with respect to the housing; and the resilient member is a spring compressed between the end wall and the retainer.

7. The combination of claim 6 wherein:

the apparatus includes a hydraulic pressure chamber in the housing;

the apparatus includes a hydraulic piston mounted for sliding movement in the housing and extending between the chamber and the rod; and the hydraulic piston coacts between the rod and the housing, thereby adjusting the position of the retainer with respect to the end wall.

8. The combination of claim 4 including a stop device for limiting the dimension, the stop device including:

a pair of position holders fixed with respect to the blade member;

a yoke releasably coupled to the position holders and coacting with the anchor member to limit movement of the blade member relative to the anchor member.

9. The combination of claim 8 wherein:

the yoke includes a face portion having a rod extending therethrough and further includes two leg portions extending from the face portion, each leg portion having a plurality of apertures;

a collar surrounds the rod and abuts the face portion when the dimension is at its maximum;

each of the position holders has a hole; and a separate pin extends into a respective one of the leg portions and a respective one of the holes, thereby securing the yoke and the blade member to one another.

10. The combination of claim 9 wherein:

the apparatus includes a hydraulic piston in the second attachment portion and coacting between the anchor member and the blade member for adjusting the position of the blade member with respect to the anchor member.

11. The combination of claim 8 wherein:

the yoke includes a face portion having a rod extending therethrough and further includes two leg portions extending from the face portion, each leg portion having an aperture;

a collar surrounds the rod and abuts the face portion when the dimension is at its maximum;

each of the position holders has a plurality of holes; and a separate pin extends into a respective one of the apertures and a respective one of the holes, thereby securing the yoke and the blade member to one another.

12. The combination of claim 11 wherein:

the apparatus includes a hydraulic piston in the second attachment portion and coacting between the anchor member and the blade member for adjusting the position of the blade member with respect to the anchor member.

13. In a dozer blade assembly including (a) a dozer blade having a top portion and a bottom digging edge, (b) a frame, (c) a mounting stanchion fixed with respect to the frame, (d) a lift cylinder coupled to the frame, (e) an angle cylinder extending between the frame and the blade, and (f) a blade pitch apparatus having an anchor member attached to the stanchion, a blade member attached to the top portion and a resilient member coacting between the anchor member and the blade member, a method for automatically adjusting the pitch of a dozer blade comprised of:

engaging the ground with the digging edge, thereby applying a force along such edge; and compressing the resilient member between the blade member and the anchor member, thereby permitting the blade to pitch forwardly.

14. The method of claim 13 wherein the anchor member includes a rod, the blade member includes a housing and the compressing step includes moving the housing along the rod.

15. The method of claim 14 wherein the blade pitch apparatus includes a stop device for adjustably limiting movement of the blade member with respect to the anchor member, the stop device including:

a pair of position holders fixed with respect to the blade member;

a yoke releasably coupled to the position holders and coacting with the anchor member to limit movement of the blade member relative to the anchor member;

and wherein the engaging step is preceded by the steps of: setting the relative positions of the holders and the yoke to one another.

16. The method of claim 13 wherein the compressing step is followed by:

lifting the edge from the ground; and expanding the resilient member, thereby tilting the top portion of the blade rearwardly.

17. An apparatus for permitting the pitch of a dozer blade to change during blade use and including:

a blade member comprising a housing having a housing wall and a blade attachment portion;

an anchor member comprising a rod telescoped to the housing and having a rod attachment portion and a retainer attached to the rod in such a manner that the housing and retainer are spaced apart by a variable dimension;

a stop device having a pair of position holders affixed to the housing and a yoke coupled to the position holders and coacting with the rod to limit movement of the housing relative to the retainer such that the minimum dimension between the housing and the retainer can be set; and a compression spring positioned between the rod and the housing in such a way that the spring, rod and housing are generally coaxial with one another, said compression spring exerting force on the wall and the retainer, thereby urging the rod and blade attachment portions closer to one another.

18. In combination, (a) a dozer blade coupled to a mounting stanchion and having a digging edge, and (b) a blade pitch apparatus having an anchor member coupled to the stanchion by a first attachment portion and a blade member coupled to an upper portion of the blade by a second attachment portion, and wherein the attachment portions are spaced by a variable dimension, the improvement wherein:

the pitch apparatus includes a resilient member coacting between the anchor member and the blade member, thereby allowing the dimension to diminish to change blade pitch when force is applied to the digging edge; and the combination includes a stop device for limiting the dimension;

and wherein such stop device includes:

a pair of position holders fixed with respect to the blade member; and a yoke releasably coupled to the position holders and coacting with the anchor member to limit movement of the blade member relative to the anchor member.

19. The combination of claim 18 wherein:

the yoke includes a face portion having a rod extending therethrough and further includes two leg portions extending from the face portion, each leg portion having a plurality of apertures;

a collar surrounds the rod and abuts the face portion when the dimension is at its maximum;

each of the position holders has a hole; and a separate pin extends into a respective one of the leg portions and a respective one of the holes, thereby securing the yoke and the blade member to one another.

20. The combination of claim 19 wherein:

the apparatus includes a hydraulic piston in the second attachment portion and coacting between the anchor member and the blade member for adjusting the position of the blade member with respect to the anchor member.

21. The combination of claim 18 wherein:

the yoke includes a face portion having the rod extending therethrough and further includes two leg portions extending from the face portion, each leg portion having an aperture;

a collar surrounds the rod and abuts the face portion when the dimension is at its maximum;

each of the position holders has a plurality of holes; and a separate pin extends into a respective one of the apertures and a respective one of the holes, thereby securing the yoke and the blade member to one another.

22. The combination of claim 21 wherein:

the apparatus includes a hydraulic piston in the second attachment portion and coacting between the anchor member and the blade member for adjusting the position of the blade member with respect to the anchor member.

* * * * *